US006872148B2

(12) United States Patent
Lee

(10) Patent No.: US 6,872,148 B2
(45) Date of Patent: Mar. 29, 2005

(54) GOLF CLUB

(76) Inventor: Steven P. Lee, 25 5th St., North Arlington, NJ (US) 07031

( * ) Notice: Subject to any disclaimer, the term of this patent is extended or adjusted under 35 U.S.C. 154(b) by 0 days.

(21) Appl. No.: 10/735,189

(22) Filed: Dec. 12, 2003

(65) Prior Publication Data

US 2004/0127301 A1 Jul. 1, 2004

Related U.S. Application Data

(60) Provisional application No. 60/433,344, filed on Dec. 13, 2002.

(51) Int. Cl.[7] ..... A63B 69/36
(52) U.S. Cl. ..... 473/131; 473/333
(58) Field of Search ..... 473/131, 324, 473/329, 333; 227/9, 10

(56) References Cited

U.S. PATENT DOCUMENTS

| | | | | | |
|---|---|---|---|---|---|
| 769,939 | A | | 9/1904 | Clark | |
| 1,825,244 | A | * | 9/1931 | James | 473/333 |
| 2,722,033 | A | * | 11/1955 | Bullwinkle et al. | 227/9 |
| 4,170,357 | A | | 10/1979 | Greer | |
| 4,461,481 | A | * | 7/1984 | Kim | 473/333 |
| 5,522,594 | A | | 6/1996 | Taylor et al. | |
| 5,816,927 | A | | 10/1998 | Taylor | |
| 5,860,869 | A | | 1/1999 | Duncalf | |
| 5,924,932 | A | | 7/1999 | Taylor | |
| 6,139,440 | A | | 10/2000 | Taylor | |
| 6,171,204 | B1 | * | 1/2001 | Starry | 473/333 |
| 6,551,199 | B2 | * | 4/2003 | Viera | 473/333 |

* cited by examiner

*Primary Examiner*—Steven Wong
(74) *Attorney, Agent, or Firm*—McCarter & English, LLP

(57) ABSTRACT

A golf club includes a shaft and a head attached to the shaft. The head has forward and rear ends and a ball-striking face positioned adjacent the forward end. The golf club is also provided with a movable member having a propellant charge therein. The movable member is positioned in the head and is movable between a first position, in which it is positioned adjacent the rear end of the head, and a second position, in which is it positioned adjacent the front end of the head. A detonating mechanism is provided for detonating the charge when the movable member moves from its first position to its second position during the movement of the head. The charge causes the head to accelerate in a generally forward direction when the charge is detonated by the detonating mechanism.

19 Claims, 4 Drawing Sheets

GOLF CLUB

CROSS-REFERENCE TO RELATED APPLICATION

This application claims the benefit of U.S. Provisional Application Ser. No. 60/433,344 filed Dec. 13, 2002.

FIELD OF THE INVENTION

The present invention relates to golf clubs and, more particularly, to a golf club having an explosive charge therein to enhance its feel and/or ball-driving ability.

BACKGROUND OF THE INVENTION

Golf clubs equipped with explosive charges have been developed in the past for various purposes. For instance, U.S. Pat. Nos. 5,522,594, 5,816,927, 5,860,869, 5,924,932 and 6,139,440 disclose ballistic impeller golf clubs. These impeller golf clubs have rather complicated manual triggering mechanisms in order to impel golf balls.

U.S. Pat. No. 4,170,357 disclose a golf club having a propellant charge therein. More particularly, the golf club has a head including a barrel provided with a rearwardly facing muzzle and containing the propellant charge. A firing pin is mounted on the ball striking face of the head such that when the golf club is swung and the ball striking face impacts a golf ball, the firing pin detonates the propellant charge so as to push the head in a forward direction. Because the firing pin projects outwardly from the ball striking face, the ball striking face is not planar and may cause the golf ball to travel in a random direction.

SUMMARY OF THE INVENTION

The present invention overcomes the disadvantages and shortcomings of the prior art discussed above by providing a new and improved golf club including a shaft and a head which is attached to the shaft. The head has forward and rear ends and a ball-striking face positioned adjacent the forward end. The golf club is also provided with a movable member having a propellant charge therein. The movable member is positioned in the head and is movable between a first position, in which it is positioned adjacent the rear end of the head, and a second position, in which is it positioned adjacent the front end of the head. A detonating mechanism is provided for detonating the propellant charge when the movable member moves from its first position to its second position during the movement of the head. The charge causes the head to accelerate in a generally forward direction when the charge is detonated by the detonating mechanism.

BRIEF DESCRIPTION OF THE DRAWINGS

For a more complete understanding of the present invention, reference is made to the following detailed description of an exemplary embodiment considered in conjunction with the accompanying drawings, in which.

DETAILED DESCRIPTION OF THE INVENTION

Figure 1:
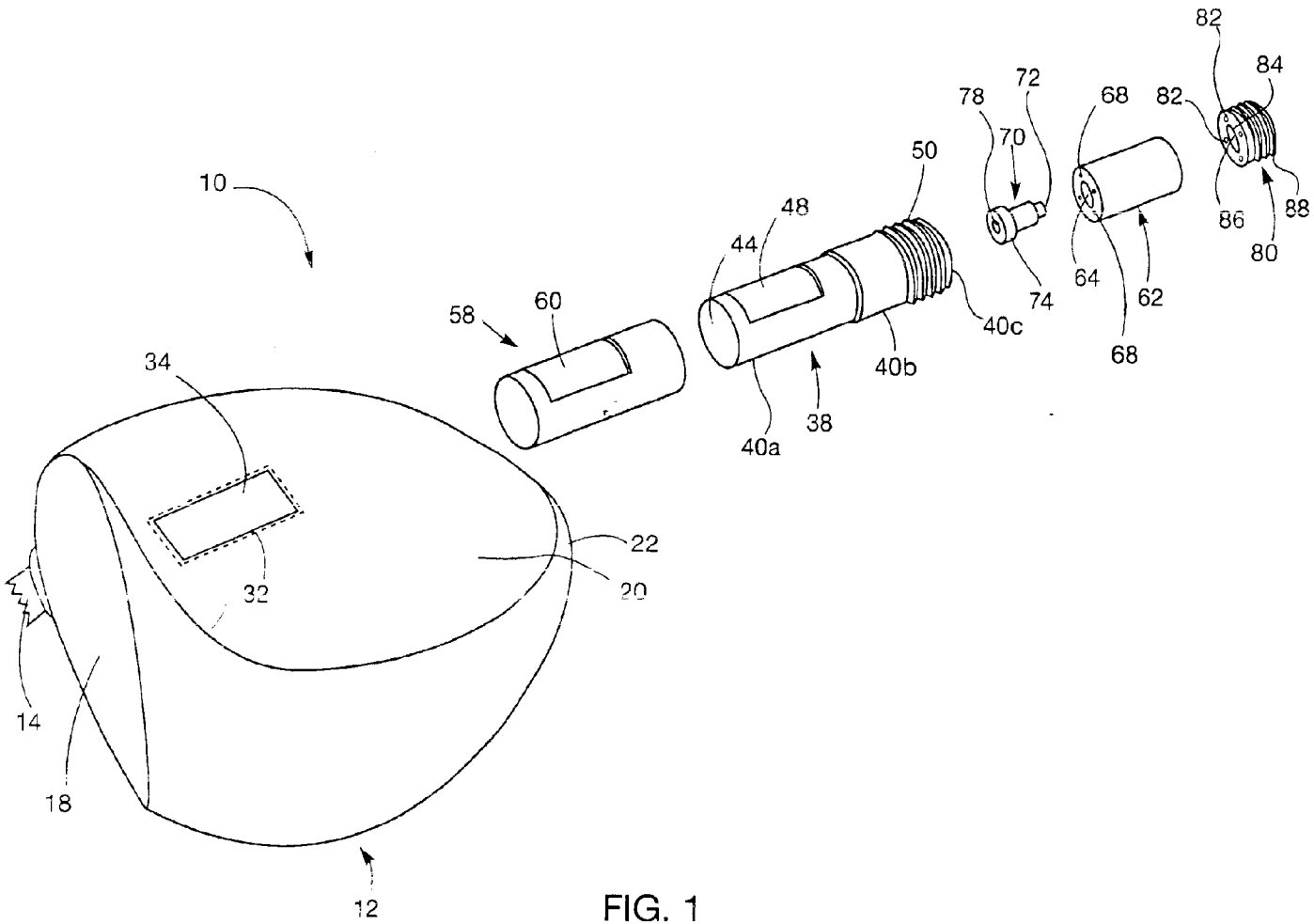
FIG. 1 is an exploded perspective view of a golf club constructed in accordance with the present invention.
Figure 2:
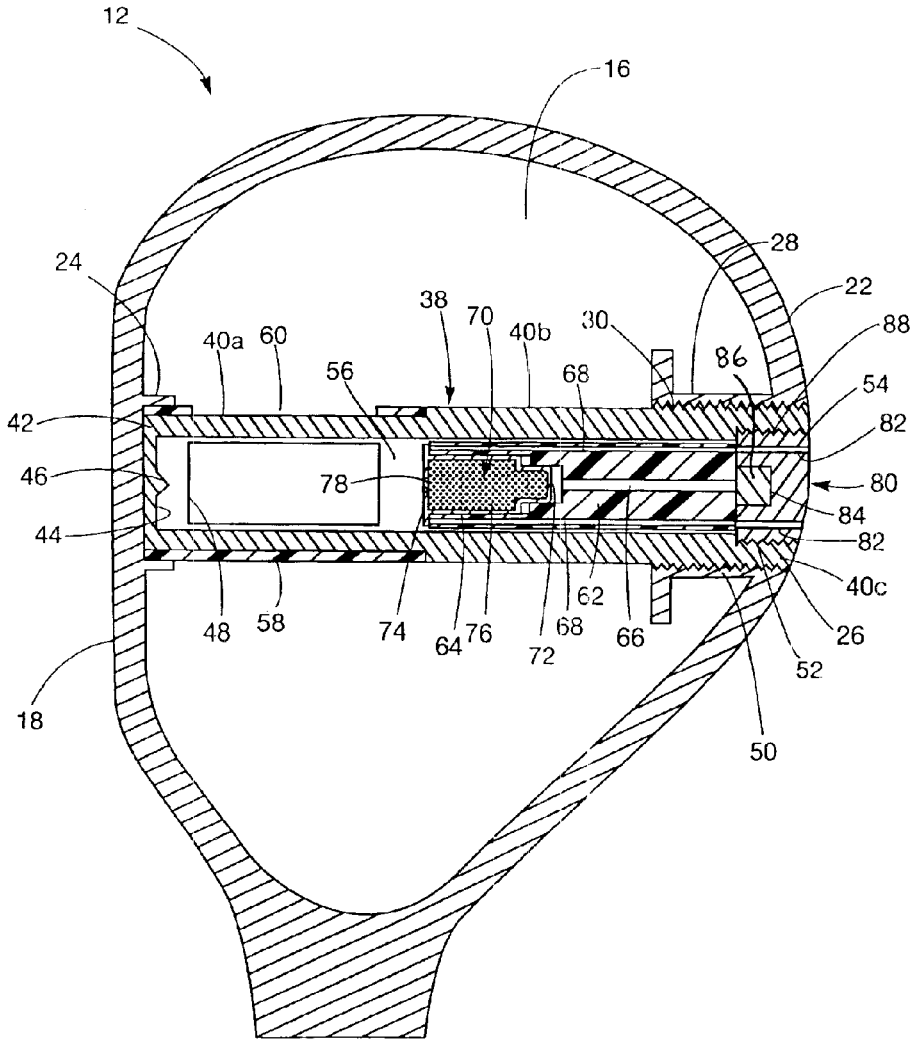
FIG. 2 is a cross-sectional view of the golf club shown in FIG. 1.
Figure 4:
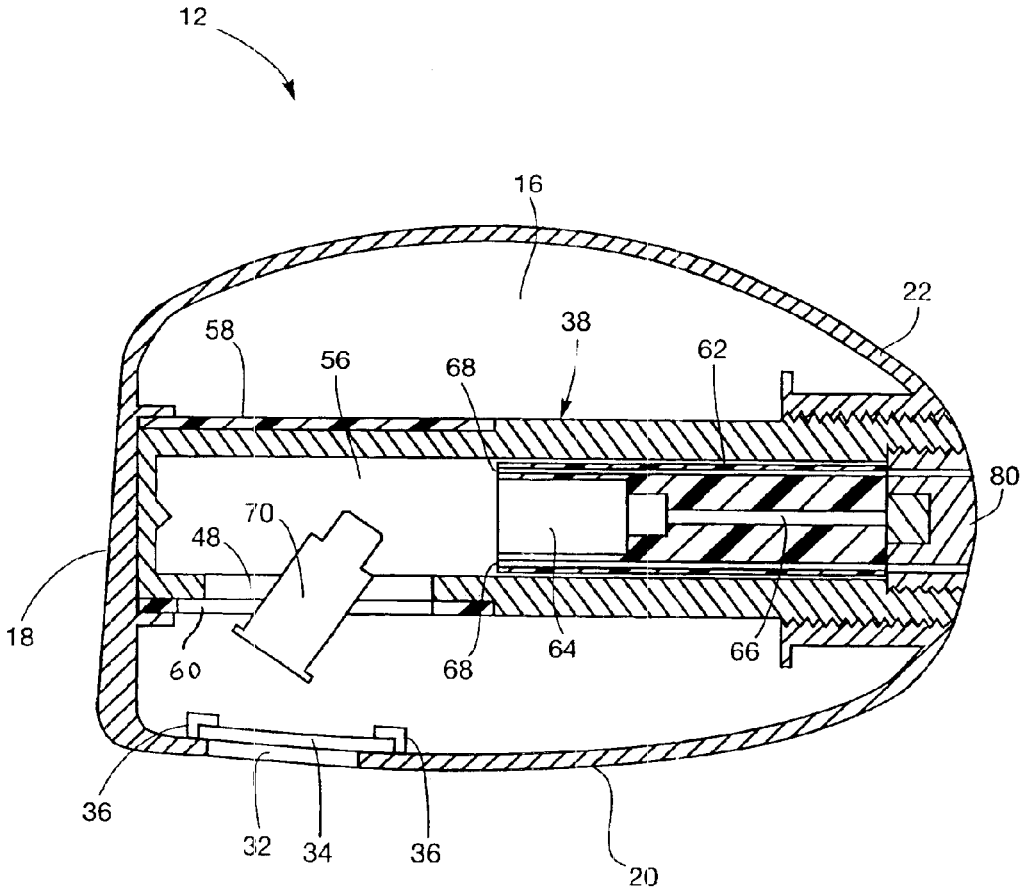
FIG. 4 is a schematic, cross-sectional view of the golf club shown in FIG. 1, illustrating the insertion or removal of a cartridge containing a propellant charge.

With reference to FIGS. 1 and 2, there is shown a golf club 10 constructed in accordance with the present invention. More particularly, the golf club 10 has a head 12 and a shaft 14 attached to the head 12. The head 12 has a hollow interior 16, an inclined ball-striking face 18, a sole 20 and a rear end 22. The head 12 also has a mounting ring 24, which projects inwardly into the hollow interior 16 from the head 12 adjacent the face 18, and a mounting hole 26, which is formed in the rear end 22 of the head 12. A mounting column 28 projects inwardly into the hollow interior 16 from the rear end 22 and has internal threads 30. An access opening 32 (see FIGS. 1 and 4) is formed in the sole 20 adjacent the face 18, while a cover 34 (see FIGS. 1 and 4) is movably mounted to the head 12 for opening and closing the access opening 32. Tracks 36 (see FIG. 4) are positioned in the head 12 for movably mounting the cover 34 to the head 12 such that the cover 34 can move between its open and closed positions. The cover 34 can be provided with a self-closing mechanism (not shown), such as a spring, such that it can move automatically from its open position to its closed position.

Still referring to FIGS. 1 and 2, the golf club 10 is provided with a cylindrical barrel member 38 mounted in the hollow interior 16 of the head 12. More particularly, the barrel member 38 includes a forward section 40*a*, a mid-section 40*b* and a rear section 40*c*. The forward section 40*a* has a forward end 42 secured in the mounting ring 24 of the head 12. The forward end 42 is equipped with a wall 44 and a firing pin 46 projecting rearwardly from the wall 42. The forward section 40*a* also includes an ejection slot 48 substantially aligned with the access opening 32 of the head 12 (see FIG. 4). The mid-section 40*b* has an outer diameter that is greater than the outer diameter of the forward section 40*a*. The rear section 40*c* is provided with external threads 50, which engage the internal threads 30 of the mounting column 28 of the head 12, as well as internal threads 52. The rear section 40*c* also has an open rear end 54. An opening 56 extends from the open rear end 54 of the rear section 40*c*, terminating at the wall 44 of the forward section 40*a*.

A sleeve 58 (see FIGS. 1 and 2) is mounted to the forward section 40*a* of the barrel member 38 and is retained in position between the face 18 and the mid-section 40*b*. An ejection slot 60 is also formed in the sleeve 58. The sleeve 58 is rotatable relative to the barrel member 38 such that the ejection slot 60 of the sleeve 58 is alignable with the ejection slot 48 of the barrel member 38 for purposes to be discussed hereinafter.

With reference to FIGS. 1 and 2, the golf club 10 also has a sliding chamber member 62 having a substantially cylindrical shape. More particularly, the chamber member 62 is received in the opening 56 of the barrel member 38 such that it is movable in a rectilinear direction therein. The chamber member 62 has a forward opening 64 and a rear opening 66. Holes 68 also extend completely through the chamber member 62.

The golf club 10 also includes a cartridge 70 sized and shaped so as to be received in the forward opening 64 of the chamber member 62 such that it is movable in the opening 56 of the barrel member 38 conjointly with the chamber member 62. The cartridge 70 has a rear end 72 and a forward end 74. More particularly, the forward end 74 is sized and shaped such that when the cartridge 70 is mounted to the chamber member 62, the forward end 74 partially or completely covers the holes 68 of the chamber member 62 for purposes to be discussed hereinafter. A propellant or explosive charge 76 is contained in the cartridge 70, while a primer 78 is mounted in the forward end 74.

An end cap 80 is removably mounted to the open rear end 54 of the barrel member 38. More particularly, the end cap 80 has a plurality of holes 82, which extend therethrough, and a cavity 84 formed in a forward end thereof. A magnet 86 is mounted in the cavity 84, while external threads 88 are formed on the end cap 80 for engaging the internal threads 52 of the barrel member 38.

Figure 3:
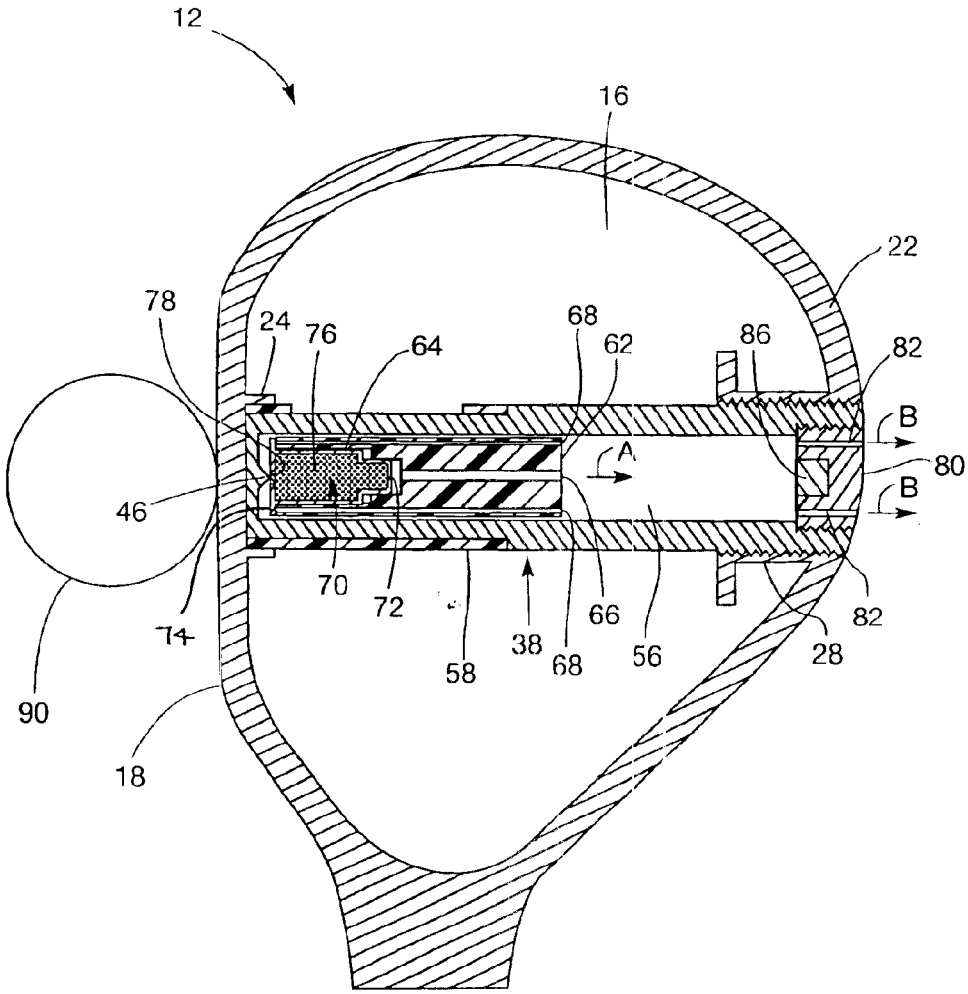
FIG. 3 is a view similar to FIG. 2, except that the gold club is at impact with a golf ball.

Prior to swinging the golf club 10, the cartridge 70 is mounted in the chamber member 62 as discussed above. The cartridge/chamber member assembly 70, 62 is held by the magnet 86 at its rear position, in which it is attached to the end cap 80, and is thereby inhibited from freely moving in the opening 56 of the barrel member 38 (see FIG. 2). When the golf club 10 is swung and impacts a ball 90 (see FIG. 3), the forward inertia of the cartridge/chamber member assembly 70, 62 causes the assembly to move in a forward direction relative to the barrel member 38, thereby striking the firing pin 46. More particularly, the primer 78 of the cartridge 70 impacts the firing pin 46, hence detonating the propelling charge 76. In response, high velocity/pressure gases are discharged from the cartridge 70 in a rearward direction through the rear end 72 of the cartridge 70. The gases discharged from the cartridge 70 are then ejected from the head 12 at a high speed through the rear opening 66 of the chamber member 62 (see arrow A in FIG. 3) and the discharge holes 82 of the end cap 80 (see arrows B in FIG. 3), thereby pushing the head 12 in a forward direction with increased energy.

During the ejection of the propellant charge 76 from the head 12, some pressurized gases are diverted in a forward direction from the space (see FIG. 3) formed in the barrel member 38 between the chamber member 62 and the end cap 80 through the holes 68 of the chamber member 62. The diverted gases apply a forwardly directed force against the forward end 74 of the cartridge 70 for the purpose of dislodging the cartridge 70 from the chamber member 62.

In order to remove the detonated cartridge 70 from the head 12, the end cap 80 is detached from the golf club 10. The cartridge 70 is then removed from the barrel member 30 through its open rear end 54 together with the chamber member 62. A new cartridge can then be attached to the chamber member 62 and inserted into the barrel member 38 for subsequent use of the golf club 10. Alternatively, the detonated cartridge 70 can be removed from the golf club 10 without detaching the end cap 80 from the head 12. To do so, the cover 34 on the sole 20 of the head 12 is moved to its open position such that the access opening 32 of the head 12 is substantially unobstructed. A person's finger is then inserted into the hollow interior 16 of the head 12 through the access opening 32 so as to rotate the sleeve 58 such that the ejection slot 60 of the sleeve 58 is aligned with the ejection slot 48 of the barrel member 38. The cartridge 70 is then removed from the opening 56 of the barrel member 38 through the ejection slot 48 of the barrel member 38 and the access opening 32 of the head 12. After removing the cartridge 70, a new cartridge can be loaded into the barrel member 38 through the access opening 32 and then the ejection slot 48. The sleeve 58 is then rotated so as to misalign the ejection slot 60 of the sleeve 58 with the ejection slot 48 of the barrel member 38. Thereafter, the cover 34 is moved to its closed position so as to close off the access opening 32.

The golf club 10 of the present invention can be used as a conventional golf club (i.e., it can be used without the cartridge 70 and the chamber member 62). More particularly, the golf club 10 can be used in a conventional manner with the barrel member 38 and the end cap 80 mounted to the head 12 in the manner discussed above, but without the cartridge 70 and the chamber member 62. When used in this way, the barrel member 38 functions to support the face 18 at impact with a golf ball. The end cap 80 can also be replaced with an end cap having a different weight so as to vary the weight of the head 12 of the golf club 10.

The golf club 10 can also be used with the chamber member 62, the barrel member 38 and the end cap 80 mounted in the head 12 in the manner described above, but without the cartridge 70. When used in this way, the chamber member 62 functions in a manner similar to the weight distribution mechanism disclosed in applicant's U.S. Pat. No. 5,366,222, the disclosures of which are incorporated herein by reference. More particularly, the chamber member 62 is adapted to strike the inner surface of the ball-striking face 18 of the head 12 upon impact with a golf ball and cause the ball to fly further.

It should be noted that the present invention can have numerous additional variations and modifications. For instance, the end cap 80 can be permanently attached to the barrel member 38. Alternatively, the cover 34, the access opening 32 of the head 12 and/or the ejection slots 48, 60 of the barrel member 38 and the sleeve 58, respectively, can be eliminated or replaced with other mechanisms. The chamber member 62 can also be eliminated or replaced with other mechanisms. Moreover, the holes 68 of the chamber member 62 can be eliminated. In addition, the magnet 86 can be placed on the chamber member 62 or can be replaced with a plurality of magnet numbers arranged in a circular fashion.

It will be understood that the embodiment described herein is merely exemplary and that a person skilled in the art may make many variations and modifications without departing from the spirit and scope of the invention. All such variations and modifications, including those mentioned above, are intended to be included within the scope of the invention as defined in the appended claims.

I claim:

1. A golf club comprising a shaft; a head attached to said shaft and having forward and rear ends and a ball-striking face positioned adjacent said forward end; a movable member having a propellant charge therein, said movable member being positioned in said head and being movable between a first position, in which it is positioned adjacent said rear end of said head, and a second position, in which is it positioned adjacent said front end of said head; and detonating means for detonating said charge when said movable member moves from its said first position to its said second position during the movement of said head, said charge causing said head to accelerate in a generally forward direction when said charge is detonated by said detonating means.

2. The golf club of claim 1, further comprising a barrel mounted in said head, said movable member being movably positioned in said barrel.

3. The golf club of claim 2, wherein said barrel extends axially between said forward and rear ends of said head.

4. The golf club of claim 3, wherein said ball-striking surface has a rear surface facing said rear end of said head, said barrel engaging said rear surface of said ball-striking surface so as to provide axial support to said ball-striking surface.

5. The golf club of claim 4, wherein said barrel has forward and rear ends, said barrel having an opening extending therethrough between said forward and rear ends of said barrel, said movable member being positioned adjacent said rear end of said barrel when said movable member is positioned in its said first position, said movable member being positioned adjacent said forward end of said barrel when said movable member is positioned in its said second position.

6. The golf club of claim 5, further comprising an end cap attached to said rear end of said barrel, said end cap being removable from said barrel such that said movable member can be removed from said barrel through said rear end of said barrel.

7. The golf club of claim 6, further comprising retaining means for releasably retaining said movable member in its said first position.

8. The golf club of claim 7, wherein said retaining means includes a magnet mounted to said end cap, said magnet releasably retaining said movable member in its said first position by a magnetic force.

9. The golf club of claim 1, wherein said detonating means is positioned adjacent the forward end of said head.

10. The golf club of claim 9, wherein said detonating means includes a firing pin, said movable member striking said firing pin when said movable member moves from its said first position to its said second position.

11. The golf club of claim 10, wherein said movable member includes a chamber member and a cartridge removably received in said chamber member, said chamber member being movable conjointly with said cartridge.

12. The golf club of claim 11, wherein said charge is housed in said cartridge, said cartridge including a primer for igniting said charge.

13. The golf club of said claim 12, wherein said cartridge is received in said chamber member such that said primer strikes said firing pin when said movable member moves from its said first position to its said second position.

14. The golf club of claim 12, wherein said charge produces a high-velocity stream of gases when said charge is detonated by said detonating means.

15. The golf club of claim 14, further-comprising directing means for directing said stream in a generally rearward direction so as to accelerate said head in said generally forward direction.

16. The golf club of claim 15, wherein said directing means includes an opening formed in said chamber member.

17. The golf club of claim 12, further comprising removing means for permitting the removal of said cartridge after the detonation of said charge.

18. The golf club of claim 17, wherein said head has a bottom, said removing means including an access opening formed in said bottom of said head, said cartridge being sized and shaped so as to be removed from said head through said access opening.

19. The golf club of claim 1, wherein said movable member moves from its said first position to its said second position when said head impacts a golf ball.

* * * * *